US005666897A

United States Patent [19]

Armstrong

[11] Patent Number: 5,666,897

[45] Date of Patent: Sep. 16, 1997

[54] SUBMARINE WEAPON-HANDLING AND DISCHARGE SYSTEM

[75] Inventor: Harold James Armstrong, Burton-on-Trent, United Kingdom

[73] Assignee: John Lindsay & Son (Decorators) Ltd., Glasgow, United Kingdom

[21] Appl. No.: 676,231

[22] PCT Filed: Jun. 8, 1995

[86] PCT No.: PCT/GB95/01339

§ 371 Date: Sep. 6, 1996

§ 102(e) Date: Sep. 6, 1996

[87] PCT Pub. No.: WO95/34466

PCT Pub. Date: Dec. 21, 1995

[30] Foreign Application Priority Data

Jun. 10, 1994 [GB] United Kingdom ..... 9411643

[51] Int. Cl.[6] ..... B63G 8/32

[52] U.S. Cl. ..... 114/20.1; 114/318; 114/238

[58] Field of Search ..... 89/1.809, 1.81; 114/20.1, 20.2, 21.1–21.3, 23, 238, 312, 316–320, 342

[56] References Cited

U.S. PATENT DOCUMENTS

| | | | |
|---|---|---|---|
| 1,037,519 | 9/1912 | Peacock | 114/238 |
| 1,356,294 | 10/1920 | Kuhajda | 89/38 |
| 1,370,467 | 3/1921 | McMahon | 114/318 |
| 2,390,688 | 12/1945 | Bradberry | 114/238 |
| 2,921,501 | 1/1960 | Parot | 89/1.51 |
| 3,356,056 | 12/1967 | Lehmann | 114/317 |
| 3,368,510 | 2/1968 | Humphrey | 114/317 |
| 3,969,977 | 7/1976 | Opdahl et al. | 89/1.81 |

FOREIGN PATENT DOCUMENTS

| | | | |
|---|---|---|---|
| 680 695 | 8/1939 | Germany | 89/1.809 |
| 2 029 516 | 11/1977 | Germany | 89/1.809 |
| 0 421 029 | 12/1934 | United Kingdom . | |

*Primary Examiner*—Michael J. Carone
*Assistant Examiner*—Matthew J. Lattig
*Attorney, Agent, or Firm*—Reid & Priest

[57] ABSTRACT

A weapons-handling and discharge system for a submarine which comprises a rotatable rack for attachment around the exterior of the pressure hull of a submarine, canisters to contain weapons, an exterior casing provided around the pressure hull, forward or rearward facing apertures in the casing, and a mechanism for discharging the weapon from the canister and through the aperture. The canisters are located between the pressure hull and the exterior casing and are locked to the rack.

34 Claims, 4 Drawing Sheets

SUBMARINE WEAPON-HANDLING AND DISCHARGE SYSTEM

This invention relates to a submarine weapon-handling and discharge system (WHDS) and to a submarine incorporating such a system. It is particularly concerned to provide a new torpedo WHDS.

Conventional torpedo WHDS in modern submarines utilise a torpedo tube arrangement in which a plurality, usually four or six, of torpedo tubes are positioned so as to extend through the pressure hull in a generally forward direction. The torpedoes are loaded into the tubes from a weapon-handling compartment located inside the pressure hull.

The position of the weapon-handling compartment is, therefore, fixed in relation to the location of the torpedo tubes while the tubes themselves are usually constrained by the size and position of the large main bow sonar array. The torpedoes are stowed on complex racks inside the weapon-handling compartment aligned with the tubes in order to allow the torpedoes to be loaded when required. Usually a mix of various torpedoes and anti-ship missiles is carried with a stowage capacity of about twenty weapons.

To launch a torpedo, first the appropriate weapon is selected from the various types stowed in the compartment and moved along the rack system until it is behind the selected torpedo tube. The torpedo tube is checked that it is empty of water and the outer door is closed. The inner door is opened and the torpedo is pushed in to the tube along rails. The inner door is then closed and locked while the submarine's fire control system feeds targeting data into the torpedo. At this point the outer door is opened as well as the outer hatch in the hull and the torpedo is launched, usually by forcing water in behind it. Sometimes the torpedo can "swim" out under its own power.

The present invention aims to provide an improved system whereby the complexity of the torpedo rack system may be reduced, the weapons-carrying capacity of the submarine may be significantly increased, the flexibility of the choice of weapon to be discharged may be improved and the loading of weapons into their stowed position is simplified.

Accordingly, in a first aspect of the invention provides a submarine having a pressure hull and an external casing, means to stow and discharge weapons, eg torpedoes, being located between the pressure hull and the external casing.

The means to stow the weapons is preferably provided as a rack of weapon canisters riding on rails attached to the outside of the pressure hull. The rack is preferably circular, ie the rails circumscribe a circle around the pressure hull. The weapons, eg torpedoes, are, therefore, carried inside the canisters and each canister is locked on to the continuous rails and is provided with means to launch its weapon.

The outer casing is provided with suitable hatches through which the weapons may be discharged and the rack may be rotatable so that selected weapons can be positioned in alignment with the hatches ready for launch.

Thus in another aspect of the invention provides a weapons-handling and discharge system for a submarine which comprises a rack for attachment around the exterior of the pressure hull of a submarine, canisters to contain weapons, an exterior casing provided around the pressure hull, the canisters being located between the pressure hull and the exterior casing, means to lock the canisters to the rack, a forward or rearward facing aperture in the casing and means to discharge the weapon through the aperture.

A single rack, which may be formed, for example, of two or three rails extending around the exterior of the pressure hull, may carry, for example, forty canisters. A canister may be designed to carry more than one weapon, eg a double weapon canister would allow forty weapons to be stowed in twenty canisters. Hence forty weapons can be carried by a single rack system, which is a considerably increase in weapon-carrying capacity compared to the twenty torpedoes of a conventional submarine. Moreover, it is possible to provide a submarine with two WHDS's of the invention, ie one forward and one rear-facing system, the latter positioned towards the rear of the submarine to allow weapons to be fired aft, thereby doubling the capacity. Thus in comparison with a conventional submarine, the weapons-carrying capacity can be quadrupled.

The canisters may be made of metal, eg stainless steel, capable of withstanding the corrosive sea water medium contained in the outer hull or they may preferably be made of a suitable composite, fibre-reinforced plastics material. They may be manufactured to a standard size and design but may be capable of holding one or more torpedoes or other weapons of various sizes by means, for example, of suitable collar mountings within the container. Thus a standard size torpedo of 21 inches (533 mm) diameter may be accommodated but, equally, a larger diameter, eg 28 inches (711 mm) diameter torpedo may instead be stowed in the same container. This feature represents a significant advantage.

Modern submarines are able to carry a variety of tactical weapons such as:

Heavyweight torpedoes—High speed, deep diving weapons capable of attacking other submarines.

Lightweight torpedoes—Used against smaller surface targets.

Anti-ship missiles—Launched in a canister and propelled to the surface. The missile's rocket then fires to launch it in to a sea-skimming profile against a surface target.

Sea mines—Submarine launch allows clandestine delivery of these area-denial weapons.

The present invention allows a mix of such weapons to be carried and more flexibly indexed into position for discharge.

Moreover, torpedo tubes have been standardised since before World War II at 21 inches diameter. Weapon designers have to design new weapons to fit existing tube dimensions otherwise in-service submarines cannot carry them, while new submarines have to have 21 inch tubes otherwise they are unable to launch in-service weapons. This problem constrains the development of weapons with greatly improved performance in terms of range, speed, on-board electronics and warhead size. There has been some move towards 26 inch tubes with one or two submarines having a mix of launch tubes of both diameters but there are significant complexities with in-board weapon-handling as well as operational constraints.

The present invention allows a much greater freedom of weapon design and selection within the chosen size of standard launch canister. As indicated above, the larger number of weapons carried will also allow an increased mix of various types to be carried with much lower operational constraints than experienced at present. Different classes of submarine may use different sized "standard" launch canisters with many weapons inside of the same type, or one canister design could be adopted for all vessels to give the greatest operational flexibility.

The canister may be designed so that it is neutrally buoyant in sea water both with its weapon inside and also after the weapon has been launched. This is a very important aspect for a WHDS because launching a torpedo from inside a submarine means a loss of weight for the submarine. This loss has to be compensated for in a conventional submarine by rapidly drawing an equal weight of water into the submarine and storing it in a special tank inside the pressure hull at the same time as the torpedo is launched. This needs special valves, pumps, pipework and the large tank itself to achieve this requirement, all of which contribute to the complexity of the submarine, use up valuable internal space and provide safety concerns due to possible valve failure causing the submarine to sink due to flooding. Again, the present invention dispenses with such needs.

As indicated above the canister is preferably made from a fibre-reinforced composite material which is light yet strong and durable. Corrosion would also be eliminated as well as magnetic signature effects. The weapon may be supported inside the canister in an inert medium such as nitrogen gas or pure water or even a special "gel" material. The choice of medium may be linked to the particular weapon which is being carried. A battery pack may be provided inside the canister to support the weapon electronics when the canister is not linked to the submarine's power supplies or the naval stores, for example during loading operations.

Once the selected canister has been rotated to the position corresponding to the selected launch door the method of launching the weapon or weapons may be one of the following:

i) allow the weapon to swim out under its own power;

ii) force the weapon out by rapid injection of water or high pressure air/gas behind the weapon through a valve at the back of the canister;

iii) have an internal storage of kinetic energy in the canister such as extended springs or fast-acting hydraulic rams which, when released, shoot the weapon out, or a propulsion unit which, when initiated, shoots the weapon out;

iv) an external hydraulic ram; or v) use of a combination of two or more of these methods.

The front of the canister may be designed to fragment or open out automatically at the moment of launch to allow free and unrestricted passage for the weapon. Once the weapon has discharged the sea water which replaces it will maintain the neutral buoyancy of the canister and hence the submarine.

The invention also provides significant improvements to the ease and speed of handling weapons. With the traditional design of submarines torpedoes are loaded into the submarine through an elaborate pressure hull hatch, winched down through the submarine on temporary rails and lowered gently down into the receiving location inside the weapon-handling compartment. Each torpedo is then manoeuvred onto one of the racks and locked into position. Moving torpedoes inside the WEDS compartment is always slow and complex.

In the present invention a simple double door arrangement may be built into the top of the external casing which opens up and out to reveal the canisters in the circular rack. An empty canister can then be lifted off and a "full" canister locked down into the free space. The on-board computer can then be told what the various weapons are with their associated data and asked to cycle the rack to place the next empty canister at the open door position so that another empty canister can be replaced with a full one, and so on until a complete reload is achieved. The empty canisters can then be returned to naval stores to be refurbished and new weapons installed. Thus direct links between the on-board computer and the individual containers in the rack may be maintained to provide on-going control during loading, storage and use of the WHDS. Substantial reductions in the time it takes to reload WHDS are envisaged even with the large increase in the weapon carrying capacity provided by the invention.

The invention may be applied to existing and new submarines. In the case of the former, where no suitable outer casing exists, it will be necessary to build such a casing over the submarine. Nevertheless in view of the advantages obtained this may in appropriate instances prove to be a viable proposition.

Thus to retro-fit the invention to existing submarines may require the installation of a complete external casing which fully envelopes the pressure hull in a hydrodynamically designed fairing. If only a forward firing system is being installed then the extension to the casing need only fair in this region and may smooth back in the transition zone to the existing pressure hull/casing. However if two racks are being installed this enlarged casing would extend the length of the pressure hull.

The advantages of the invention are manifold in comparison with a conventional submarine and its WHDS.

Weapons carried inside a conventional submarine are a very dangerous cargo. The warheads need to be handled carefully as well as the fuel used to power them when they are launched. Some fuels are toxic and leaks into the submarine's atmosphere can pose severe health risks. Fire on board within a WHDS compartment or a space adjacent to it could endanger the whole crew and safety of the vessel. Isolating the weapons from damaging shock forces is also difficult, compounding these safety problems even further. Another major concern to existing submarine designs is the possibility of both outer and inner doors of the torpedo tube being open at the same time causing a rapid flooding and loss within seconds of the submarine. Complex safety locks, hydraulic and back up systems are employed to minimise this risk.

In the present invention each weapon is isolated from the submarine by virtue of being outside the pressure hull, but at the same time is protected by the external casing. Consequently there is no chance of any weapon being exposed to fire or accidental damage from inside the submarine, while shock forces can be more easily catered for by the design of the rack, canister holding points and the canister design itself. With no torpedo tubes the risk of flooding with both inner and outer doors being open at the same time is removed. The need for highly expensive, heavy metal castings where the torpedo tubes pass through the pressure hull is eliminated.

As torpedoes are usually carried inside the WHDS compartment of conventional submarines these weapons are designed to be maintained at intervals by the crew. With the invention this is not possible and existing torpedo designs may have to be upgraded to enable them to remain on stand by without maintenance. However, this can be done utilising known technology. (Modern naval missile systems are usually stored in canisters without the need for maintenance when being carried by the warship).

An electronic link (eg using fibre optics) may be constantly monitored between the weapon in the canister and the submarine's fire control computer to enable the weapon to report its status and availability for launch including health diagnostics. The same link allows the computer to give target data to the weapon just prior to launch and afterwards if it uses wire guidance.

In a preferred embodiment, eight outer doors in the external casing are provided for a forward-mounted WHDS of the invention. Each door may be operated by a simple hydraulic arm. These doors may be positioned around the circumference of the external casing which is designed to enclose the pressure hull at a constant spacing of for example, approximately 1.25 meters. The position of these doors in this embodiment is directly disposed to correspond to the position of the canisters on the rack. With forty single weapon canisters a canister is therefore positioned at every nine degrees around the 360 degree circumference. Hence each of the eight doors is at a forty five degrees separation when they are positioned equidistant from each other. However, non-regular spacing may be adopted if each spacing is a hole multiple of nine degrees eg 36 or 54 degrees. By careful choice of weapon position on the rack when loading, a mix of eight weapons may be ready to launch without the initial need to rotate the rack. Four rotations of nine degrees each will therefore position all of the remaining stowed weapons adjacent to a launching door.

All the above calculations assume a rack size of 40 canisters; a rack size of 36 single weapon canisters would, of course, have the canisters at ten degrees spacings, with six or nine doors being the most efficient number of launching positions.

In another preferred embodiment an aft facing rack designed to fire the weapons to the rear has forty weapons canisters and employs only four doors so as to fire in between the four control surfaces (upper and lower rudders and port and starboard hydroplanes/stabilisers).

The rack system preferably comprises two or three parallel rails which encircle the pressure hull around which would turn a complete chain of links. Each link has Seating means and locks to mount a canister. The whole chain of links (a rack) may be driven around by an hydraulically powered externally-mounted rotor mounted, eg at the top of the pressure hull. Two motors are preferably installed as a safety measure.

The rack is preferably designed to expand and contract as the pressure hull expands and contracts under decreasing and increasing pressure. This expansion may be catered for by a suitable spring arrangement around the rack.

Specific embodiments of the invention are now described by way of example only with reference to the accompanying drawings in which.

Figure 1:
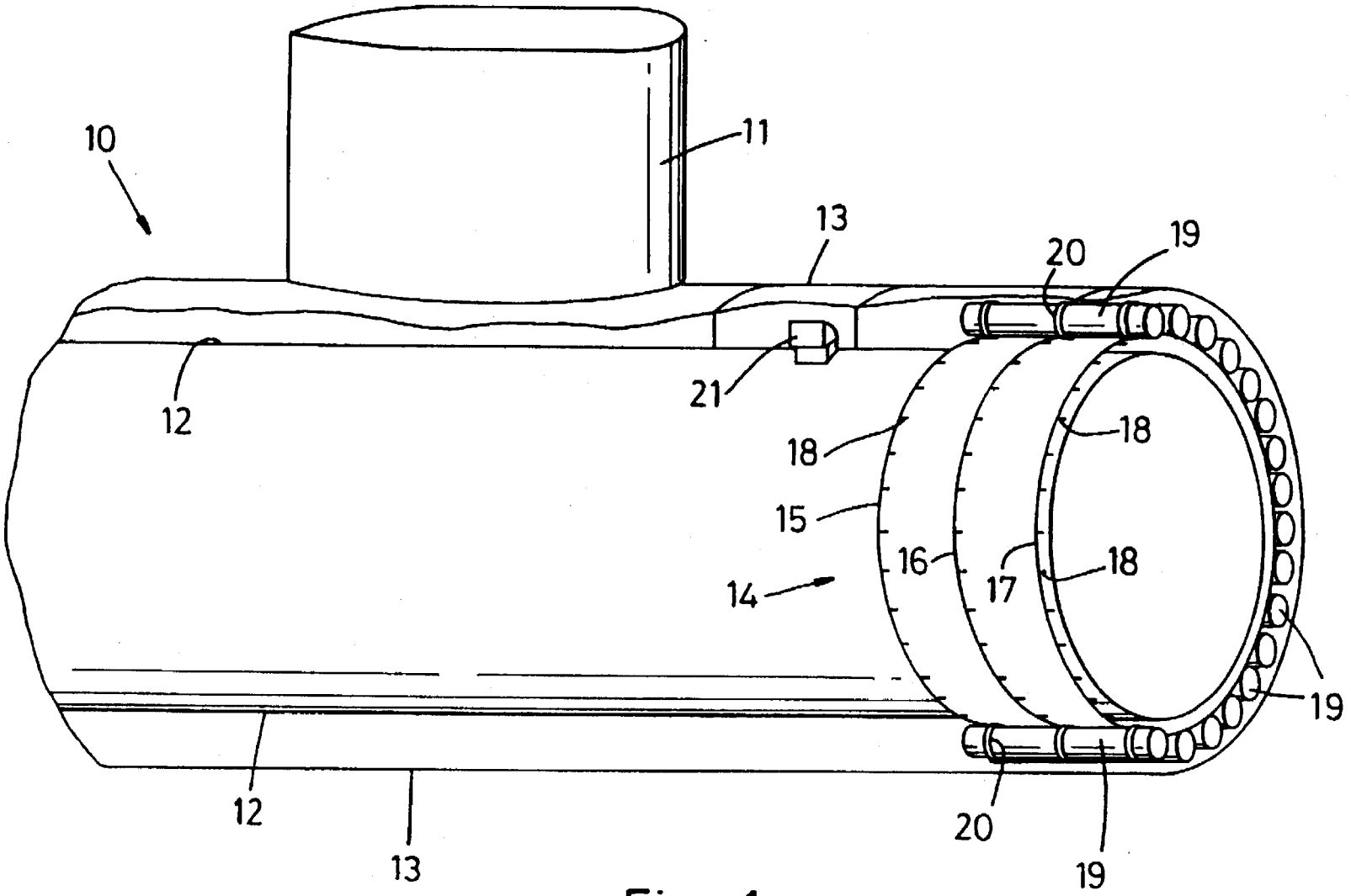
FIG. 1 is a diagrammatic illustration in perspective view with parts cut away of a submarine of the invention with a forwardly-directed WHDS.

In FIG. 1, submarine 10 has a conventional conning tower 11, a pressure hull 12 and an external casing 13 surrounding the pressure hull.

A circular rack 14 comprising three parallel rails 15, 16, 17 is attached around the exterior of pressure hull 12 towards the forward end of the submarine. The rails are provided at intervals with springs (not shown) to accommodate expansion and contraction. Anchorage points 18 on each rail provide means of connecting the rail to the pressure hull and forty weapon-containing canisters 19 are attached to the rack by connectors 20. Less than half of the full complement of forty canisters are shown for clarity. Each canister may sit on a cradle or trolley to be attached to the rack. A hydraulic motor 21 is mounted on the pressure hull to drive the rack and/or canister trolleys around the rails in response to commands from the onboard computer.

Figure 2:
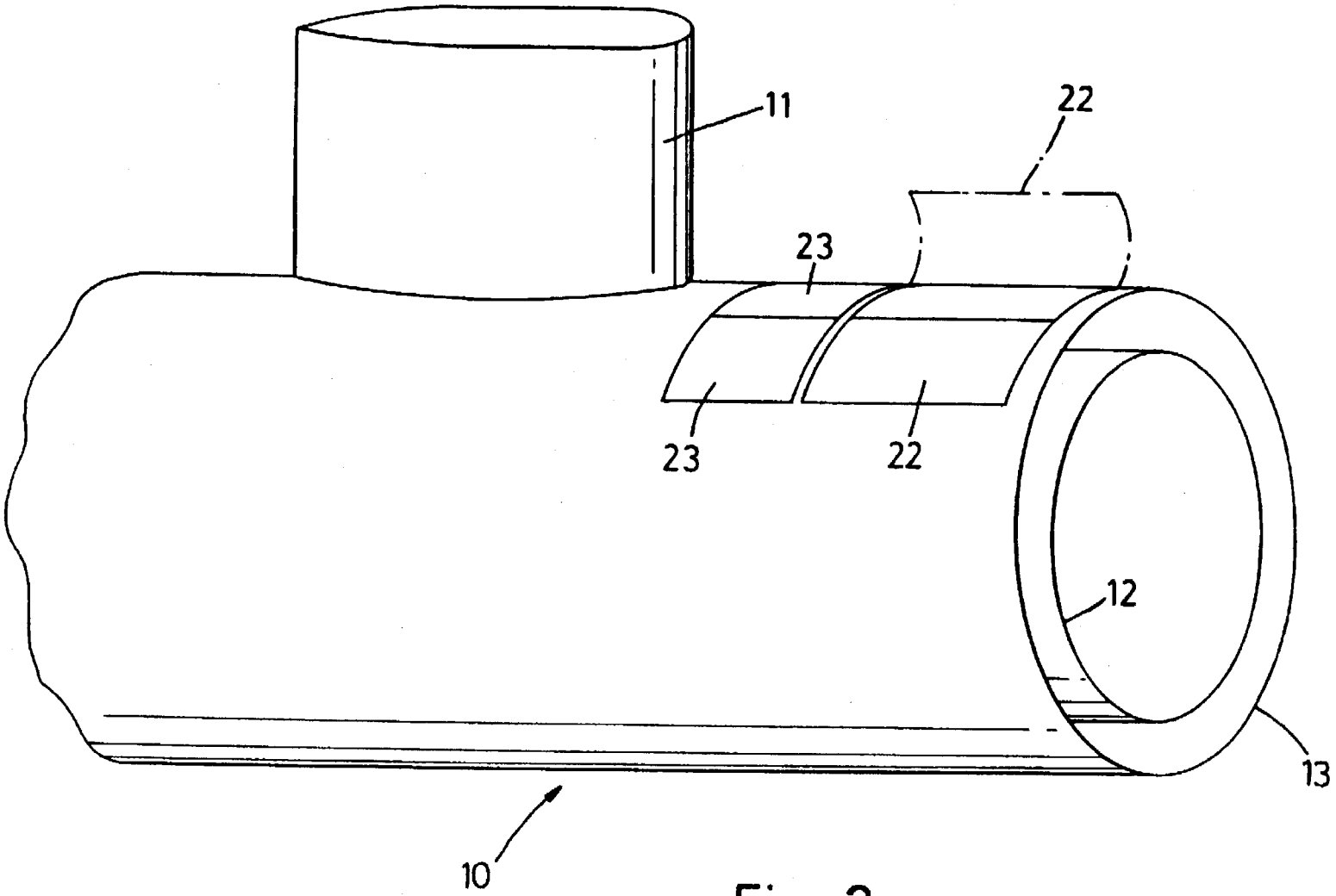
FIG. 2 is a diagrammatic illustration in perspective view with parts cut away of the submarine of FIG. 1, showing the access and loading doors to the WHDS.

In FIG. 2, a pair of loading doors 22 is provided in external casing 13 forward of conning tower 11 to provide access for loading and unloading canisters onto and from the rack 14 of FIG. 1. Behind doors 22, another pair of access doors 23 is provided in the external casing to provide access to the hydraulic motors used to drive the rack.

Figure 3:
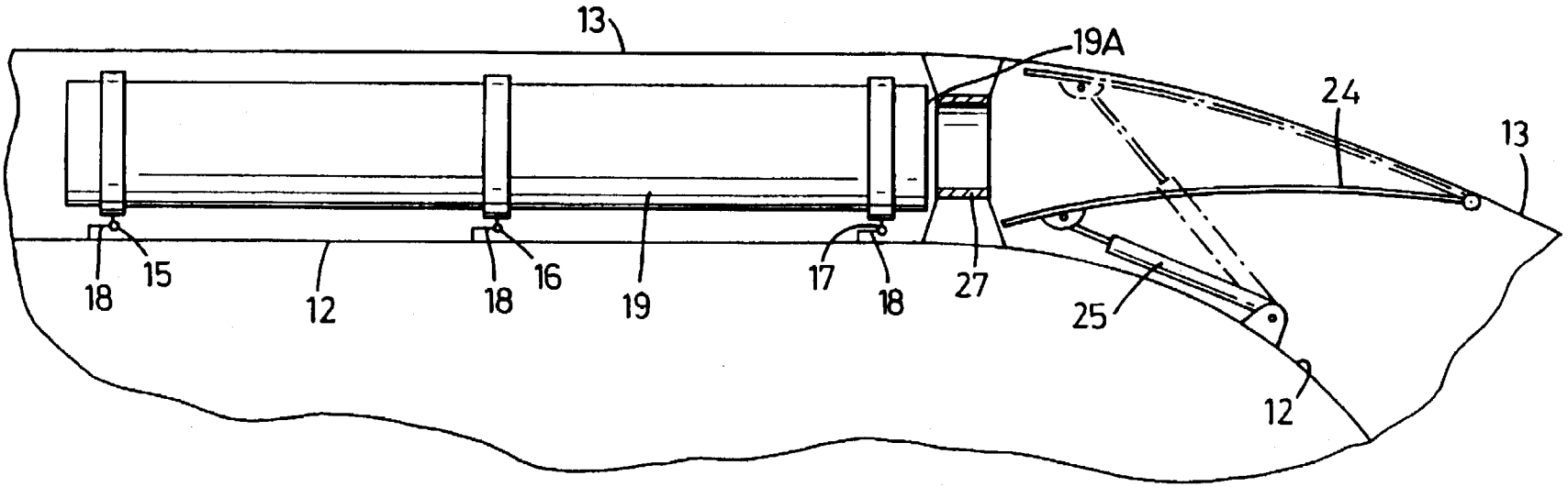
FIG. 3 is a longitudinal section through a portion of a submarine of the invention showing details of the operation of a door through which a weapon is to be launched.

In FIG. 3, a canister 19 is shown attached to the rails 15, 16 and 17. The rails in turn are attached to the pressure hull 12 by three anchorages 18. The forward end of the canister has a front 19A designed to fragment or open out on discharge of the weapon from the canister. An outer door 24, through which the weapon contained in canister 19 can be discharged is shown in the open position. It is opened and closed by hydraulic ram 25 mounted on pressure hull 12 and the closed position is shown in broken lines. A fixed launching tube is located at 27 through which the weapon is fired.

Figure 4:
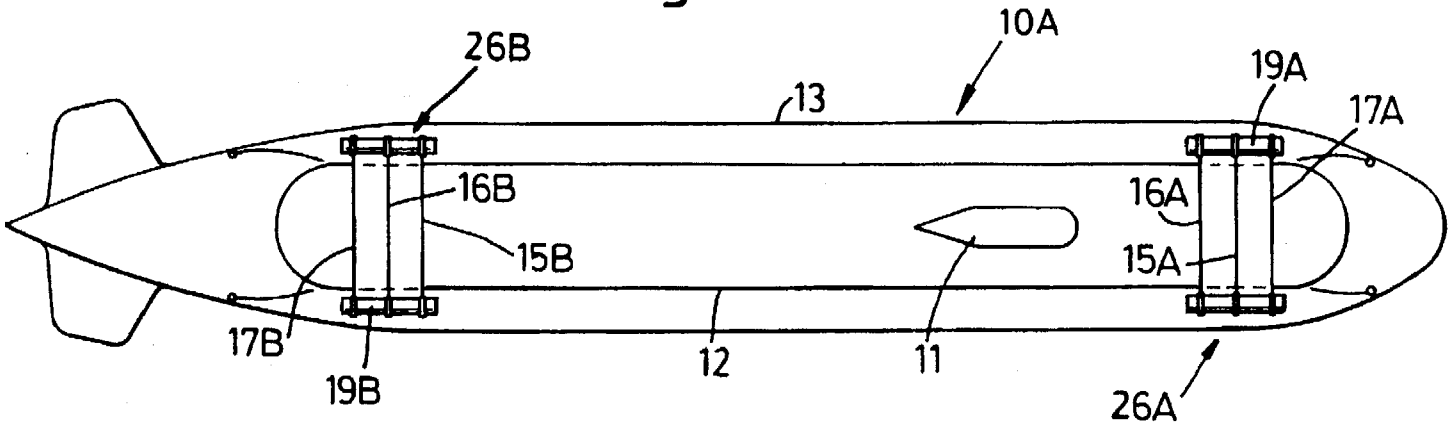
FIG. 4 is a diagrammatic illustration showing a submarine of the invention with two WHDS systems, one fore and one aft.

In FIG. 4, submarine 10A has been provided with two WHDS systems 26A, 26B, one fore and one aft respectively. As shown in FIG. 1, each system comprises a series of forty canisters 19A, 19B respectively mounted on a rack comprising three rails 15A, 16A, 17A, and 15B, 16B, 17B respectively.

Figure 5:
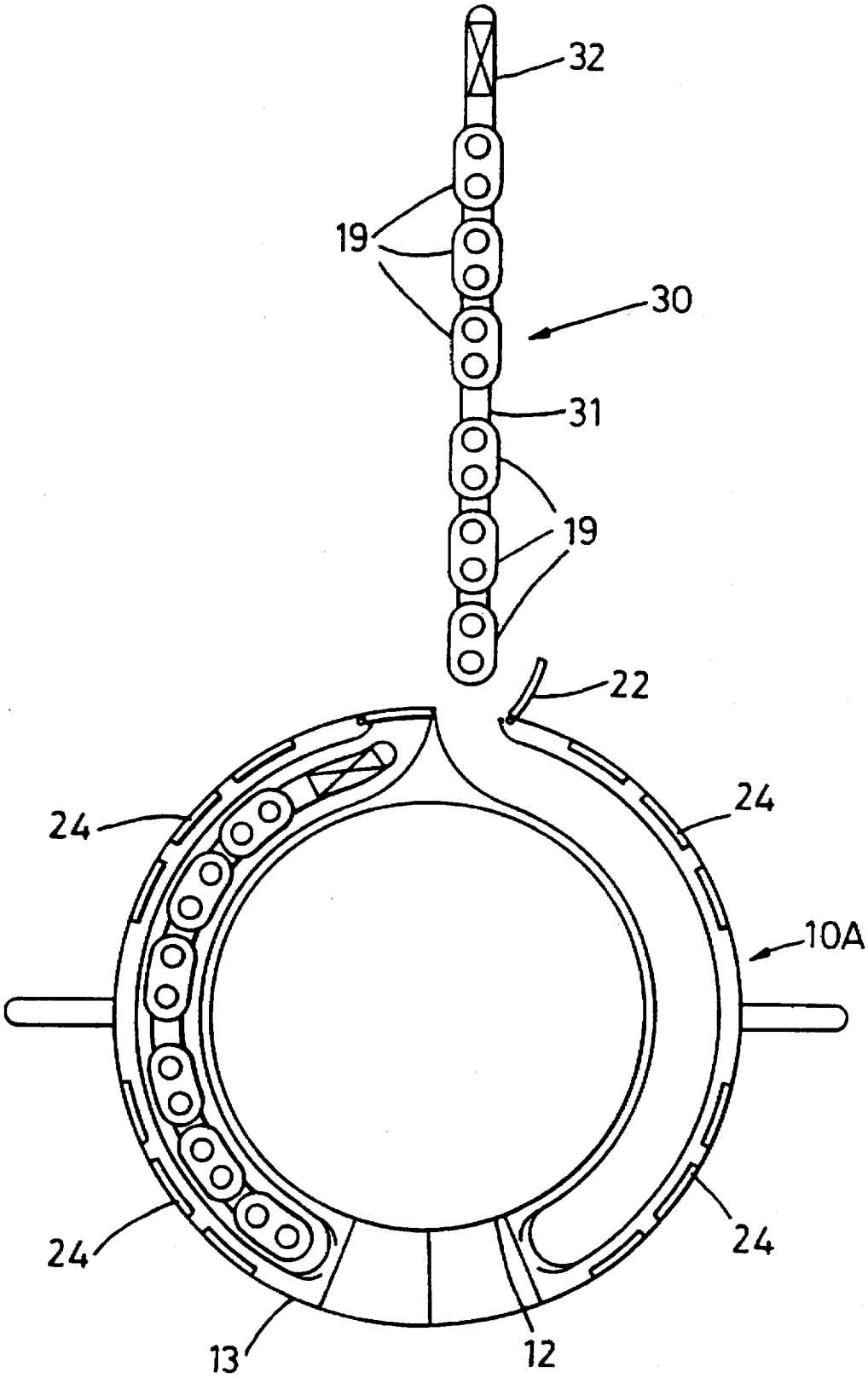
FIG. 5 is a diagrammatic illustration in cross section of a submarine provided with a WHDS according to a further embodiment of the present invention.

A further embodiment of the present invention is shown in FIG. 5 of the drawings wherein a plurality of canisters 19 are connected together in a flexible string 30 and are loaded into the cavity between the pressure hull 12 and the outer casing 13 of the submarine. A flexible coupling 31 is provided between each of the adjacent canisters 19. The strings 30 are loaded through a pair of loading doors 22 in the top of the outer casing 13. A plurality of doors 24 are located around the outer casing 13, the location of the doors corresponding to the positions of the canisters 19 when loaded. A string of canisters 30 is loaded into either side of the cavity. In the Figure, six canisters 19 and six doors 24 are shown on each side of the submarine 10A although any number may be provided as required. The doors 24 close over the top of the canisters 19 as described above so that when a door is opened a weapon can be fired directly from the canister which is revealed, either fore or aft of the submarine without transporting the weapon clear of the submarine body.

A sensor (not shown) may be located within the cavity, at the lowermost point. The sensor is activated by the presence of a string of canisters 30 in the cavity and may retain the string in the correct firing position.

A power pack 32 is mounted at the top of the string of canisters to support the weapon electronics when the string 30 is not linked to the submarines power supplies or the naval stores, for example during loading operations.

The strings 30 are loaded from a crane either at a quay side or alternatively from the deck of a support vessel to allow the submarine to be re-loaded at sea.

The weapons are fired from the canisters 19 in the same way as described above with respect to the first embodiment.

As before, each canister 19 is shown as containing two weapons although this is only a preferred arrangement and any number of weapons may be stored in each canister.

I claim:

1. A weapons-handling and discharge system for a submarine having a pressure hull, which system comprises:

a rack for attachment around the exterior of the pressure hull of the submarine, said rack being rotatable around an axis extending the length of the pressure hull, a plurality of canisters to contain weapons, said canisters having longitudinal axes parallel to the longitudinal axis of the pressure hull, an exterior casing provided around the pressure hull, the canisters being located between the pressure hull and the exterior casing, means to lock the canisters to the rack, a plurality of forward or rearward facing apertures in the casing, and means to discharge the weapons from the canisters and through the apertures.

2. A weapons-handling and discharge system according to claim 1, wherein the rack is adapted to and contracts as the pressure hull of the submarine expands and contracts under increasing and decreasing pressure.

3. A weapons-handling and discharge system according to claim 1, wherein thereof plurality of canisters are flexibly connected together and loaded between the pressure hull and the exterior casing.

4. A weapons-handling and discharge system according to claim 1, wherein the canisters are made of a composite fibre reinforced plastics material.

5. A weapons-handling and discharge system according to claim 1, wherein the canisters are neutrally buoyant in sea water.

6. A weapons-handling and discharge system according to claim 1, the weapons include electronics and wherein a battery pack is provided inside the canister to support the weapon electronics when the canister is not linked to the submarine power supplies.

7. A weapons-handling and discharge system according to claim 1, wherein the means to discharge the weapon from the canister comprises a hydraulic ram to force the weapon from the canister.

8. A weapons-handling and discharge system according to claim 1, wherein the means to discharge the weapon from the canister comprises a spring force stored in the canister behind the weapon.

9. A weapons-handling and discharge system according to claim 1, wherein the means to discharge the weapon from the canister comprises a gas pressure introduced into the canister.

10. A weapons-handling and discharge system according to claim 1, wherein the front of the canister is frangible and designed to fragment at the launch of the weapon.

11. A weapons-handing and discharge system according to claim 1, further comprising means to monitor an electronic line between the weapon and a microprocessor in the submarine to enable the status of the weapon to be checked.

12. A weapons-handling and discharge system according to claim 1, wherein the rack comprises a plurality of rails extending around the exterior of the pressure hull.

13. A weapons-handling and discharge system according to claim 12, further comprising a chain of links provided over the rails.

14. A weapons-handling and discharge system according to claim 13, further comprising means for rotating the chain.

15. A weapons-handling and discharge system according to claim 14, wherein the means for rotating the chain comprises a motor.

16. A weapons-handling and discharge system according to claim 13, wherein each link has a seating means for mounting a canister thereon.

17. A weapons-handling and discharge system according to claim 16, further comprising means for rotating the chain.

18. A weapons-handling and discharge system according to claim 17, wherein the means for rotating the chain comprises a motor.

19. A weapons-handing and discharge system according to claim 1, further comprising a door over each aperture in the casing which opens to allow the weapon to exit.

20. A weapons-handling and discharge system according to claim 19, wherein means are provided for opening the door in the exterior casing.

21. A weapons-handling and discharge system according to claim 22, wherein the opening means comprises a hydraulic ram.

22. A weapons-handling and discharge system according to claim 1, wherein an inert medium is provided within the canisters for supporting the weapons.

23. A weapons-handling and discharge system according to claim 22, wherein the inert medium is nitrogen gas.

24. A weapons-handling and discharge system according to claim 22, wherein the inert medium is pure water.

25. A weapons-handling and discharge system according to claim 22, wherein the inert medium is a gel material.

26. A weapons-handling and discharge system according to claim 1, wherein the rack is rotatable around the exterior of the pressure hull.

27. A weapons-handling and discharge system according to claim 26, wherein the rack comprises a plurality of rails extending around the exterior of the pressure hull.

28. A weapons-handling and discharge system according to claim 27, further comprising a chain of links provided over the rails.

29. A weapons-handling and discharge system according to claim 28, further comprising means for rotating the chain.

30. A weapons-handling and discharge system according to claim 29, wherein the means for rotating the chain comprises a motor.

31. A weapons-handling and discharge system according to claim 28, wherein each link has a seating means for mounting a canister thereon.

32. A weapons-handling and discharge system according to claim 31 further comprising means for rotating the chain.

33. A weapons-handling and discharge system according to claim 32, wherein the means for rotating the chain comprises a motor.

34. A submarine comprising:

a pressure hull, an external casing provided around the pressure hull, and a weapons-handling and discharge system including:

a rack for attachment around the exterior of the pressure hull of the submarine, said rack being rotatable around an axis extending the length of the pressure hull, a plurality of canisters to contain weapons, the canisters having longitudinal axes parallel to the longitudinal axis of the pressure hull and being located between the pressure hull and the casing, means to lock the canisters to the rack, a plurality of forward or rearward facing apertures in the casing, and means to discharge the weapon from its canister and through the aperture.

* * * * *